United States Patent [19]

Matsumoto

[11] Patent Number: 4,574,847

[45] Date of Patent: Mar. 11, 1986

[54] ROTARY DRUM TYPE WEFT STORAGE APPARATUS

[75] Inventor: Hiroyasu Matsumoto, Ishikawa, Japan

[73] Assignee: Tagawa Kikai Co., Ltd., Kanazawa, Japan

[21] Appl. No.: 691,898

[22] Filed: Jan. 16, 1985

[30] Foreign Application Priority Data

Jan. 20, 1984 [JP] Japan ..... 59-9313

[51] Int. Cl.[4] ..... D03D 47/36

[52] U.S. Cl. ..... 139/452; 242/47.01

[58] Field of Search ..... 139/452; 242/47.01, 242/47.12, 47.13

[56] References Cited

U.S. PATENT DOCUMENTS 3,702,176 11/1972 Rosen ..... 242/47.01
4,015,447 4/1977 Philip ..... 242/47.01

FOREIGN PATENT DOCUMENTS 93189 11/1983 European Pat. Off. ..... 139/452
2031995 11/1970 France ..... 139/452
49-12875 3/1974 Japan ..... 139/452

*Primary Examiner*—Werner H. Schroeder
*Assistant Examiner*—Steven Shongut
*Attorney, Agent, or Firm*—Moonray Kojima

[57] ABSTRACT

A rotary drum type weft storage apparatus for a shuttleless weaving machine of the type wherein a weft yarn from a yarn supply source is wound up onto and stored on a rotating yarn storing drum. It comprises a holding drum provided on a yarn releasing side of a yarn storing drum, a ring loosely fitted on an outer periphery of the holding drum, a retaining member for retaining the ring, and a reciprocal driving mechanism for moving the retaining member into and out of engagement with the larger diameter portion of the holding drum.

7 Claims, 8 Drawing Figures

ROTARY DRUM TYPE WEFT STORAGE APPARATUS

BACKGROUND OF THE INVENTION

1. Field of the Invention

This invention relates to a weft storage apparatus for storing a weft yarn of a predetermined length preceding to supplying thereof to a shuttleless loom, and more particularly to a weft yarn end retaining device in a rotary drum type weft storing apparatus.

2. Prior Art

In an air jet loom or a water jet loom, it is required to store a weft yarn of a predetermined length preceding to supplying thereof. To this end, a weft storing apparatus is located adjacent a yarn supply source side of a weft feeding nozzle. Such weft storage apparatus may be of an air sucking or jetting type, a fixed drum type, a rotary drum type and so on. A weft storage apparatus of the rotary drum type has an advantage that reduction of the speed and stopping of a weft yarn upon completion of supplying thereof is effected so smoothly that breakage of a weft yarn occurs seldom during weaving at a high speed, resulting in an excellent operability. However, such a rotary drum type weft storage apparatus requires a yarn end holding device for holding an end of a weft yarn while it is being wound up on a yarn storing drum.

Known yarn end holding devices either include a ring in the form of a comb or a brush located adjacent a weft releasing side end of a yarn storing end or otherwise use a whirling air flow for holding a weft yarn. However, a yarn end holding device of the former type has a drawback that a weft yarn is released while slidingly contacted with the brush or comb so that it is acted upon by a high and uneven releasing resistance and hence is not subject to a uniform tensile force. On the other hand, a yarn end holding device of the latter type has a drawback that it consumes a large quantity of air and hence a large power and accordingly a measuring irregularity is high. In addition, yarn end holding devices of such conventional types have another drawback that, if a hard twist yarn is employed, a weft yarn cannot be held assuredly and hence types of weft yarns to be used are limited.

A yarn end holding device of a different type is also known wherein a gripping disk is located adjacent a weft releasing side of a yarn storing drum and is moved back and forth so that a weft yarn may be gripped by and between a side end portion of the yarn storing drum and the gripping disk. This type of yarn end holding device, however, has a drawback that it has a complicated structure because a mounting structure for such a gripping disk becomes complicated and a weft yarn to be released is required to pass the center of the gripping, resulting in difficulty in adjustment of a gripping force so that weaving defects may occur since a weft yarn may be acted upon by a large gripping force.

SUMMARY OF THE INVENTION

The present invention has been made to resolve such drawbacks of the conventional yarn end holding devices as described above, and it is an object of the invention to provide a yarn end retaining device wherein an end of a weft yarn to be wound up onto a yarn storing drum can be retained assuredly without causing a measuring irregularity, a releasing resistance to a weft yarn is low so that it can be released smoothly, and a gripping force can be adjusted easily depending upon a type of a yarn to be used, and which is simple in construction and is low in power consumption.

A rotary drum type weft storage apparatus of the present invention comprises a holding drum provided on a yarn releasing side of a yarn storing drum, a ring loosely fitted on an outer periphery of the holding drum, the holding drum having at a portion thereof adjacent the yarn storing drum a larger diameter portion for retaining the ring, a retaining member for retaining the ring, which is mounted in opposing relationship to the larger diameter portion of the holding drum for relative motion in an axial direction of the holding drum, and a reciprocal driving mechanism for moving the retaining member into and out of engagement with the larger diameter portion of the holding drum.

In a rotary drum type weft storage apparatus according to the present invention, a retaining member located in opposing relationship to a larger diameter portion of a holding drum is mechanically moved back and forth so as to grip a weft yarn between the retaining member and a ring loosely fitted on the holding drum. Accordingly, a weft yarn can be assuredly held at an accurate timing so that no measuring irregularity will not be caused, and besides releasing resistance upon releasing of a weft yarn can be reduced very low due to an eccentric motion of the ring. Further, since gripping of a weft yarn is effected while the weft yarn is bent or curved at a portion thereof adjacent a side edge of the ring, no sudden gripping force will act upon the weft yarn, and besides adjustment of such a gripping force can be effected easily depending upon a type of the weft yarn used so that any type of weft yarns can be stored assuredly and will cause no weaving irregularity. In addition, the apparatus of the invention has a further characteristic that, since the ring acts to control ballooning of a weft yarn upon releasing of the weft yarn, there is no necessity of provision of a cover for preventing such ballooning, resulting in simplification of the apparatus.

DETAILED DESCRIPTION OF THE INVENTION

Figure 1:
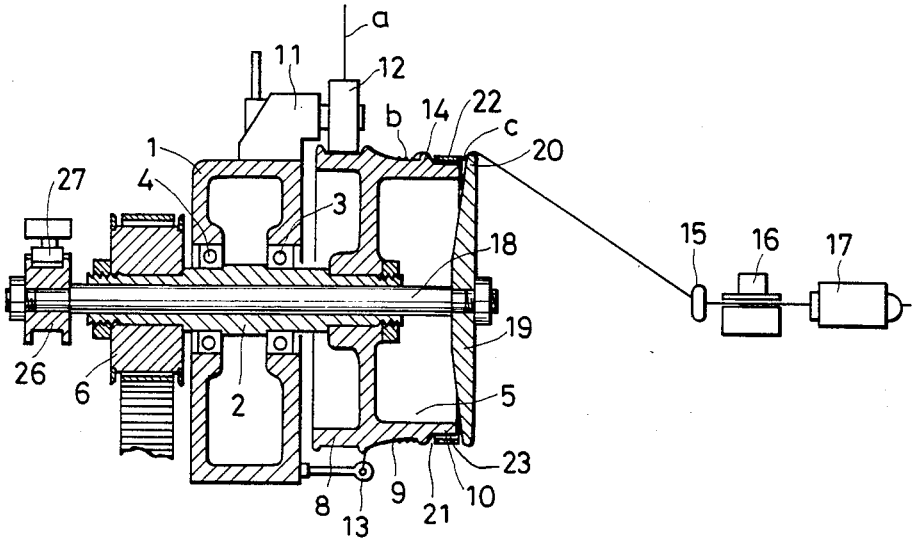
FIG. 1 is a sectional view showing one embodiment of a weft storage apparatus of the present invention.

Description will be given of construction of the invention using reference symbols of embodiments illustrated in the drawings. A rotary drum type weft storage apparatus according to the invention includes a rotating yarn storing drum 9 onto which a weft yarn a from a yarn source is wound up to store it thereon. Adjacent a weft releasing side of the yarn storing drum 9, there is disposed a holding drum 10 which has a ring 22 or 22*a* loosely fitted on an outer circumference thereof. The holding drum 10 has a larger diameter portion 14 or 14*a* provided adjacent the yarn storing drum 9 for retaining the ring 22 or 22*a*, and a retaining member 20 for retaining the ring 22 or 22*a* is located in opposing relationship to the larger diameter portion 14 or 14*a* of the holding drum 10 and is mounted for relative movement in an axial direction of the holding drum 10. A reciprocal driving mechanism 28 is also provided which moves the retaining member 20 into and out of engagement with the larger diameter portion 14 or 14*a* of the holding drum 10 in synchronism with a crank shaft of a weaving machine or loom. Thus, the retaining member 20 is moved toward the larger diameter portion 14 or 14*a* of the holding drum 10 to grip a weft yarn c passing between the holding drum 10 and the ring 22 or 22*a* so as to allow winding and storing of the weft yarn, and on the other hand, the retaining member 20 is moved away from the larger diameter portion 14 or 14*a* to release the weft yarn c therefrom.

EMBODIMENTS OF THE INVENTION

FIGS. 1 to 4 illustrate an embodiment of the present invention. Reference numeral 1 designates a casing, 2 a hollow shaft mounted for rotation in the casing by means of bearings 3 and 4, 5 a rotary drum fixedly mounted at an end of the hollow shaft 2, and 6 a pulley fixedly mounted at the other end of the hollow shaft 2 and adapted to be driven to rotate at a fixed speed from a drive device not shown by way of a timing belt 7 extending around the pulley 6. The rotary drum 5 has a measuring drum 8, a yarn storing drum 9 and a holding drum 10 integrally formed thereon. Reference numeral 11 denotes a bracket fixedly mounted on the casing 1, 12 a gripping roller mounted for rotation on the bracket 11 and engaged with an outer periphery of the measuring drum 8 so as to be rotated thereby, and 13 a yarn guide implanted on the casing 1. Thus, a weft yarn a from a yarn supply source not shown is clamped between the measuring drum 8 and the gripping roller 12 and is drawn out onto the measuring drum 8 by rotation of the drum 8 so that it is guided onto the yarn storing drum 9 by the yarn guide, 13 so as to be wound and stored onto the yarn storing drum 9. Between the yarn storing drum 9 and the holding drum 10, a rib or flange 14 having a larger diameter is formed for preventing a weft yarn b on the yarn storing drum 9 from moving toward the holding drum 10 and for preventing movement of a ring 22, which will be hereinafter described, which is loosely fitted on the holding drum 10. Reference numeral 15 denotes a yarn guide, 16 a gripper and 17 a feeding nozzle.

Reference numeral 18 designates a sliding shaft fitted for sliding movement on the hollow shaft 2 in an axial direction. The sliding shaft 18 is coupled to the hollow shaft 2 by means of a sliding key or the like not shown so that they may rotate in integral relationship with each other. Reference numeral 19 denotes a retaining disk fixedly mounted at an end of the sliding shaft 18. An outer peripheral edge of the retaining disk 19 forms a retaining member 20 which extends outwardly from an outer circumferential face of the holding drum 10. Accordingly, on the outer periphery of the holding drum 10, a recessed groove 21 is defined by the larger diameter portion provided by the rib 14 and the retaining member 20. The ring 22 is loosely fitted in the recessed groove 21 with a gap 23 left between the ring 22 and the outer periphery of the holding drum 10. Engaging faces 24 and 25 (refer to FIG. 3) of the rib 14 and the retaining member 20, respectively, adjacent the ring 22 are each formed as a tapered face. Thus, the weft yarn b wound on the yarn storing drum 9 is introduced to the feeding nozzle 17 passing between the holding drum 10 and the ring 22.

Figure 2:
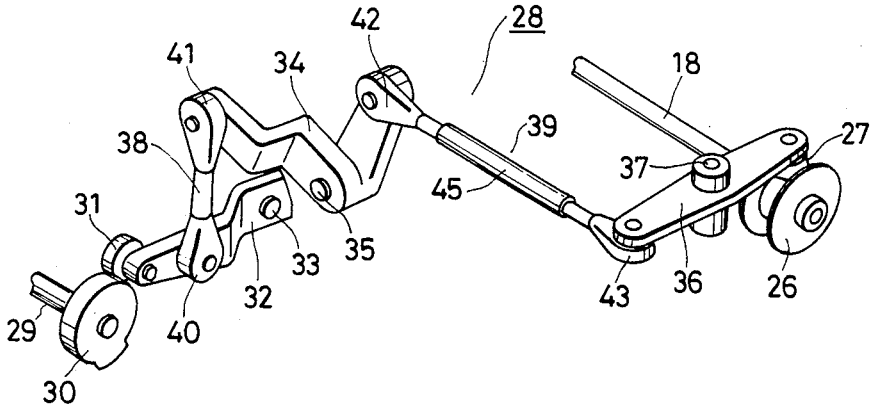
FIG. 2 is a perspective view of a reciprocal driving mechanism for moving a retaining member back and forth as viewed from behind the apparatus.

A pulley 26 is fixedly mounted at the other end of the sliding shaft 18, and a roller 27 of a reciprocal driving mechanism for moving the retaining disk 19 in the axial direction of the drum is fitted on the pulley 16. FIG. 2 illustrates the reciprocal driving mechanism 28, and reference numeral 29 designates a gripper cam shaft which is rotating in synchronism with a crank shaft of a weaving machine or loom, 30 a plate cam fixedly mounted on the gripper cam shaft 29, 31 a cam follower mounted in engagement with the plate cam 30, and 32 a gripper actuating lever mounted for pivotal motion on a frame, not shown, of the weaving machine by means of a pivot pin 33. The cam follower 31 is mounted for rotation on the gripper actuating lever 32 such that rotation of the cam 30 will rock the gripper actuating lever 32 to open and close the gripper 16. The reciprocal driving mechanism 28 has a structure for converting a rocking motion of the gripper actuating lever 32 into a reciprocal motion of the sliding shaft 18, and reference numeral 34 designates a crank lever mounted for pivotal motion on a stationary member by means of a pivot pin 35, 36 a lever mounted for pivotal motion on the stationary member by means of a pivot pin 37, 38 a rod connecting the gripper actuating lever 32 to an end of the crank lever 34, 39 another rod connecting the other end of the crank lever 34 to a base end of the lever 36, and reference numerals 40 to 43 denote each a spherical joint provided at each of connecting ends of the rods 38 and 39. The roller 27 is mounted for rotation at an end of the lever 36 and is fitted in a groove of the pulley 26 with a small gap left therebetween. Thus, rocking motion of the gripper actuating lever 32 caused by rotation of the cam 30 is transmitted to the crank lever 34 by vertical movement of the rod 38, and rocking motion of the crank lever 34 moves the rod 39 leftwardly and rightwardly to rock the lever 36. This rocking motion of the lever 36 is transmitted to the sliding shaft 18 via the roller 27 and the pulley 26 so that the retaining member 20 is moved into and out of engagement with the rib 14.

Figure 3:
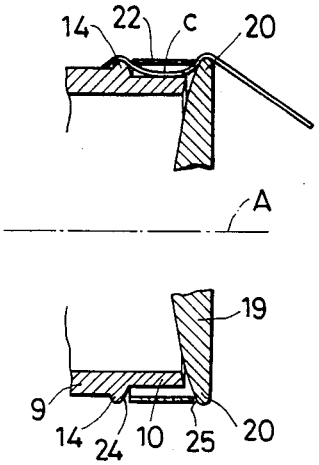
FIG. 3 is a partial sectional view showing a weft yarn retaining condition.

FIG. 3 illustrates the ring 22 when the retaining member 20 is positioned adjacent the rib 14. In this position, the ring 22 is clamped at opposite sides thereof by the rib 14 and the retaining member 20. Since the ring engaging faces 24 and 25 of the rib 14 and the retaining member 20 are formed as tapered faces, the ring 22 is centered with a drum axis A as it is clamped at opposite sides thereof. Thus, while a weft yarn is being wound up onto the yarn storing drum, the weft yarn c passing between the holding drum 10 and the ring 22 is clamped and held between the ring 22 and the rib 14 and also between the ring 22 and the retaining member 20 with the weft yarn c bent or curved at portions thereof adjacent opposite side edges of the ring 22.

In this case, the weft yarn c is not required to be clamped firmly between the ring 22 and the rib 14 and between the ring 22 and the retaining member 20. This is because a holding force sufficient to allow a weft yarn to be wound can be obtained by frictional resistance provided to portions thereof at which it is bent or curved by opposite side edges of the ring 22. To what degree the holding force is adjusted is determined depending upon a type of a yarn used, and such adjustment is attained by adjusting the position of the retaining member 20 to which it is moved to the rib 14. In the reciprocal driving mechanism 28 of the embodiment shown, a turnbuckle 34 is provided on the rod 39 so as to allow adjustment of the length of the rod 39 to thus allow adjustment of the position of the retaining member 20 when a weft yarn is gripped thereby.

Figure 4:
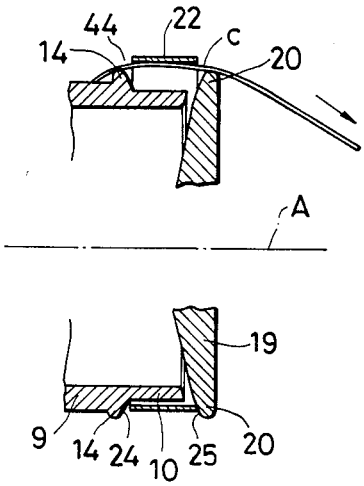
FIG. 4 is a partial sectional view showing a weft yarn releasing condition.

When a weft yarn on the yarn storing drum 9 is to be released, the retaining member 20 is moved away from the rib 14. This movement of the retaining member 20 releases clamping of the ring 22 at opposite sides thereby to allow eccentric motion and deformation of the ring 22 on the outer periphery of the holding drum 10. If in this position the feeding nozzle 17 is rendered operative, then a portion of the ring 22 along which the weft yarn c passes is pressed up and deformed eccentrically as seen in FIG. 4 by the weft yarn c due to a tensile force acting upon the weft yarn c, thereby forming a weft yarn path 44 between the ring 22 and the holding drum 10 at the weft yarn c passing portion. Accordingly, a weft yarn on the yarn storing drum 9 can be released smoothly without resistance passing the path 44. In order that the eccentric direction of the ring 22 may follow a weft yarn as it turns around the outer periphery of the holding drum 10 while being released from the yarn storing drum 9, preferably the ring 22 is in the form of a light and flexible belt while having sufficient rigidity to prevent the ring 22 from being bent or curved when it is clamped between the rib 14 and the retaining member 20, and besides it has a smooth surface and a low coefficient of friction. If the ring 22 has sufficient flexibility, the weft yarn path 44 of FIG. 4 can be formed more easily by deformation of the ring 22. The ring 22 may have a cross section not only of a belt but also of an arc, a pipe and so on.

Figure 5:
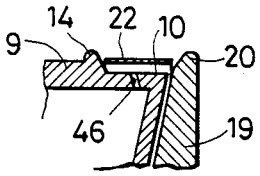
FIGS. 5 to 8 are partial sectional views illustrating different modified forms of a structure of a weft yarn retaining section of the apparatus according to the invention.

FIGS. 5 to 8 illustrates different embodiments of the weft yarn retaining section of the apparatus according to the present invention. FIG. 5 illustrates a modified form wherein a number of air outlets 46, for example, in the form of slits, are formed in an outer periphery of a holding drum 10 so that a weft yarn may be retained and released while air is being blown out through the air outlets 46 to a ring 22. Thus, by blowing air through the outlets 46 to bring the ring 22 into a floating position, the aforementioned centering and eccentric moving motions of the ring 22 can be effected more smoothly and besides occurrence of vibrations and flapping motions of the ring 22 upon releasing of a weft yarn can be controlled.

Figure 6:
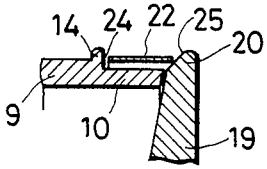
Figure 7:
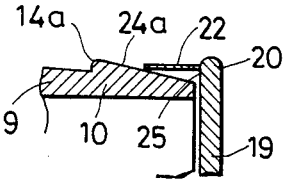

FIG. 6 illustrates another modified form wherein a ring engaging face 24 of a rib 14 provided on a holding drum 10 extends in a vertical plane while only a ring engaging face 25 of a retaining member 20 is formed as a tapered face. Since a centering action of the ring 22 by a tapered face is provided only if either one of the engaging faces 24 and 25 which clamp the ring 22 therebetween is a tapered face, even such a structure as shown in FIG. 6 can assure retaining and releasing operations of a weft yarn without a trouble by the action as described above. A further modified form as shown in FIG. 7 is also possible wherein an outer peripheral face of the holding drum 10 is formed as a face so tapered as to provide a greater diameter **14*a* to the holding drum 10 adjacent the yarn storing drum instead of provision of a larger diameter portion by the rib of the holding drum 10. Also in this modified form, a centering action of the ring 22 can be attained by the tapered face 24*a*, allowing retaining and releasing of a weft yarn by a similar action. It is to be noted that, in the arrangement of FIG. 7, a weft yarn is bent or curved, upon gripping thereof, only at a portion thereof between the ring 22 and the retaining member 20. Further, if the retaining member 20 is moved away from the holding drum 10, then the ring 22 is moved to a smaller diameter portion of the tapered face 24*a* to thus provide a gap between the tapered face 24*a* and the ring 22. Accordingly, the ring 22 can be formed as a conical ring which is shaped in conformity with the tapered face 24*a***.

Figure 8:
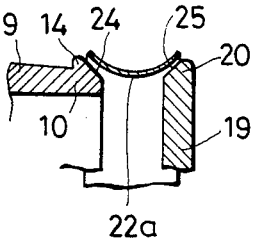

FIG. 8 illustrates a still further modified form wherein the holding drum 10 only has a larger diameter portion 14 and a contiguous ring engaging face 24. This structure will cause no trouble in retaining or releasing of a weft yarn since retaining of a weft yarn in the apparatus of the present invention is effected between opposite edges of the ring 22 and the opposing engaging faces 24 and 25. It is to be noted that a ring **22*a* having an arcuate cross section is used in the arrangement shown in FIG. 8**.

In the embodiments described hereinabove, at least one of ring engaging faces of a larger diameter portion of a holding drum and of a retaining member opposing to the larger diameter portion is formed as a tapered face. Since this structure will allow centering of a ring 22 to a holding drum 10 when a weft yarn is to be clamped, the ring 22 is restricted uniformly along the entire periphery thereof by the ring engaging face so that the weft yarn is held more assuredly. On the other hand, upon releasing of the weft yarn, a sufficient gap is provided between the ring engaging face and the ring 22 in a manner contrary to that described above so that resistance to the weft yarn being released can be reduced very low. However, it is also possible to attain corresponding effects even with an arrangement wherein both ring engaging faces are formed as vertical faces.

What is claimed is:

1. A rotary drum type weft storage apparatus for a shuttleless weaving machine of the type wherein a weft yarn from a yarn supply source is wound up onto and stored on a rotating yarn storing drum, characterized in that it comprises a holding drum provided on a yarn releasing side of said yarn storing drum, a ring loosely fitted on an outer periphery of said holding drum, said holding drum having at a portion thereof adjacent said yarn storing drum a larger diameter portion for retaining said ring, a retaining member for retaining said ring, said retaining member being mounted in opposing relationship to said larger diameter portion of said holding drum for relative motion in an axial direction of said holding drum, and a reciprocal driving mechanism for moving said retaining member into and out of engagement with said larger diameter portion of said holding drum, whereby said retaining member is moved to said larger diameter portion of said holding drum so that the weft yarn passing between said holding drum and said ring may be gripped to allow winding and storing of the weft yarn whereas said retaining member is moved away from said larger diameter portion so that the weft yarn may be released.

2. A rotary drum type weft storage apparatus for a shuttleless weaving machine of the type wherein a weft yarn from a yarn supply source is wound upon onto and stored on a rotating yarn storing drum, characterized in that it comprises a holding drum provided on a yarn releasing side of said yarn storing drum, a ring loosely fitted on an outer periphery of said holding drum, said holding drum having at a portion thereof adjacent said yarn storing drum a larger diameter portion for retaining said ring, a retaining member for retaining said ring, said retaining member being mounted in opposing relationship to said larger diameter portion of said holding drum for relative motion in an axial direction of said holding drum, and a reciprocal driving mechanism for moving said retaining member into and out of engagement with said larger diameter portion of said holding drum, whereby said retaining member is moved to said larger diameter portion of said holding drum so that the weft yarn passing between said holding drum and said ring may be gripped to allow winding and storing of the weft yarn whereas said retaining member is moved away from said larger diameter portion so that the weft yarn may be released; wherein said reciprocal driving mechanism is moved in synchronism with a crank shaft of the weaving meachine.

3. A weft storage apparatus according to claim 2, wherein said reciprocal driving mechaism has a structure for converting a rocking motion of a gripper actuating lever for a gripper, which is disposed between the weft storage apparatus and a weft feeding nozzle along a path of the weft, into a reciprocal motion of a sliding shaft of the retaining member.

4. A weft storage apparatus according to claim 2, wherein at least one of ring engaging faces of said larger diameter portion of said holding drum and said retaining member is formed as a tapered face.

5. A weft storage apparatus according to claim 2, wherein said holding drum has an air outlet formed in an outer peripheral face thereof, whereby gripping and releasing of the weft yarn is effected while air is jetted out from said air outlet to an inner bore of said ring.

6. A weft storage apparatus according to claim 2, wherein said ring is in the form of a light and flexible belt having a smooth surface and a low coefficient of friction.

7. A weft storage apparatus according to claim 6, wherein said ring has a cross section of an arc.

* * * * *